United States Patent [19]

Jorwa

[11] 4,018,330

[45] Jan. 19, 1977

[54] MATCHBOOK WITH SAFETY PANEL

[76] Inventor: Mildred M. Jorwa, 71 Lincoln Ave., Fair Lawn, N.J. 07410

[22] Filed: Aug. 25, 1976

[21] Appl. No.: 717,546

[52] U.S. Cl. ..... 206/106; 206/137

[51] Int. Cl.[2] ..... A24F 27/00

[58] Field of Search ..... 206/91, 104, 106, 108, 206/110, 113, 137

[56] References Cited

UNITED STATES PATENTS

| | | | |
|---|---|---|---|
| 2,090,712 | 8/1937 | Wachholz | 206/110 |
| 2,104,621 | 1/1938 | McKinnon, Jr. | 206/106 |
| 2,118,726 | 5/1938 | Edwards | 206/108 |
| 2,133,909 | 10/1938 | Thomas | 206/108 |

*Primary Examiner*—Steven E. Lipman

*Attorney, Agent, or Firm*—Silverman and Jackson

[57] ABSTRACT

The present invention exhibits a match and matchbook cover having in slideable disposition behind the matches; a safety panel having disposed at the forward edge thereof a friction panel wherein the matchbook is provided with a slit which permits the selectable extension of said friction area from the safety panel upon the application of slide pressure by the user. Similarly, the friction panel can be readily withdrawn by a user through a simple withdrawal of the sliding panel.

1 Claim, 8 Drawing Figures

MATCHBOOK WITH SAFETY PANEL

BACKGROUND OF THE INVENTION

The present invention relates to safety means associated with matchbooks intended to reduce fire and other hazards, particularly to children, associated with commonly used cardboard matchbooks. More particularly, it is to be appreciated that the exterior disposition of the friction strip of a normal matchbook presents an invitation for any child to experiment with. That is, the conventional, so-called safety matches have, in actuality, proven to afford safety only with respect to extremely young children. It has been found that a child, upon reaching about three years of age, possesses little difficulty in lighting a match from the so-called safety matchbook.

Accordingly, it is the intention of the present invention to provide a new type of safety matchbook which will afford the desired safety feature to a broader age range of children.

The prior art in the present field is characterized by such patents as U.S. Pat. Nos. 2,090,712 (1937) to Wachholz; 1,658,849 to Lichtendorf; 2,118,726 (1938) to Edwards; and 2,845,172 (1958) to Fridolph.

While the above art suggest various approaches to improving the safety factor in cardboard matchbooks, the above has not served as a practical and effective means for attaining the desired result.

SUMMARY OF THE INVENTION

The present invention comprises a matchbook cover having, in slidable dispostion behind the matches, a safety panel having disposed at the forward end thereof a friction panel, wherein the matchbook is provided with a slit which permits the selectable extension of said friction area from the safety panel upon the application of slide pressure by a user. Similarly, the friction panel can be readily withdrawn by a user through a simple withdrawal of the sliding panel.

One object of the present invention resides in the provision of a novel and improved protective container for safety matches that will protect both the matches as well as the striking surface.

A further object of the present invention resides in the provision of a novel and improved container for safety matches characterized by simplicity, effectiveness and dependability.

It is a further object of the present invention to provide a container for matches which will provide complete protection against accidental striking of unprotected matches against the striking surface.

It is yet a further object to provide an improved holder for safety matches which will not be susceptible to either accidental or intentional ignition by children under six years of age.

BRIEF DESCRIPTION OF THE INVENTION

DETAILED DESCRIPTION OF THE INVENTION

Figure 1:
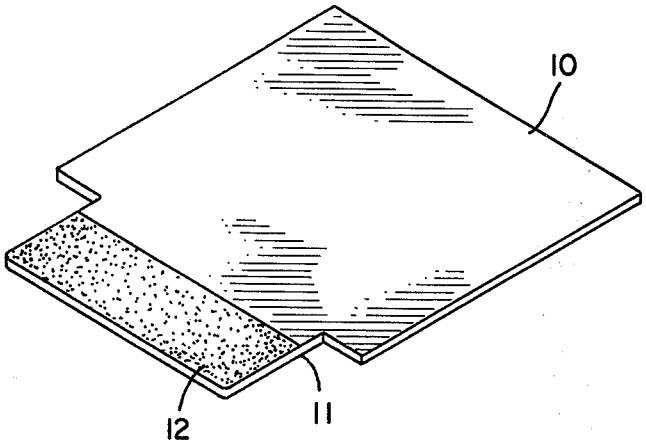
FIG. 1 is a perspective view of the safety panel utilized in association with the present inventive safety match booklet.

There is shown in FIG. 1 a safety panel 10 intended for usage in association with the present safety booklet. It is noted that the panel 10 is provided with a tongue 11, upon both sides of which there is disposed a friction strip 12.

Figure 2:
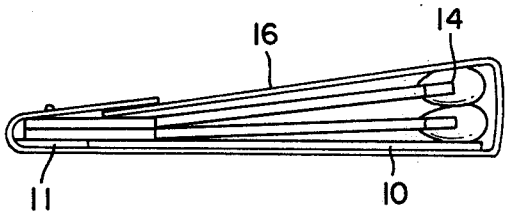
FIG. 2 is a side-plan view of the present match booklet showing the safety panel in a retracted position.

With reference to FIG. 2, it is seen that the panel 10 occupies a normally hidden position behind the matches 14 and within the matchbook cover 16. That is, while the booklet is closed, the panel and associated friction strips are completely hidden from view. Further, it is to be appreciated that after the front portion 18 of the booklet is opened, the safety panel still remains hidden. Accordingly, most children would not perceive any means of striking a match.

Figure 3:
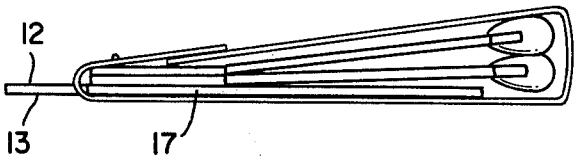
FIG. 3 is a view similar to FIG. 2, however showing the safety panel in an extended position.
Figure 4:
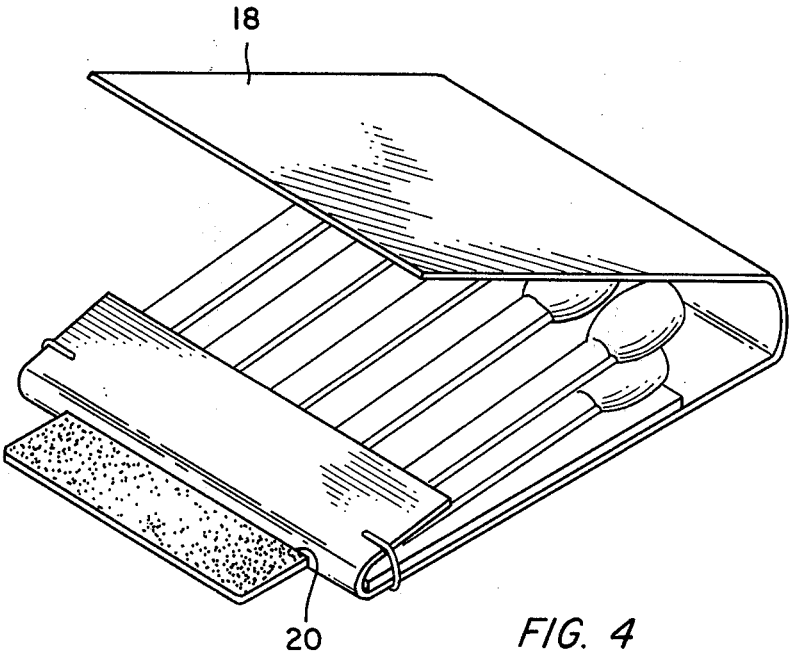
FIG. 4 is a perspective view of the present safety match booklet illustrating the safety panel in an extended position.

In order to achieve an extension of the tongue 11 and its friction strips 12, it is, by reference to FIGS. 3 and 4, to be appreciated that the panel 10 must be physically pushed forward through a slit 20 in the matchbook cover. Upon extension of the tongue 11, the match can readily be ignited thereon.

Following the ignition of a match, the tongue 11 is simply pressed back through slot 20 and behind the matches in order to re-assume the condition of FIG. 2.

Figure 5:
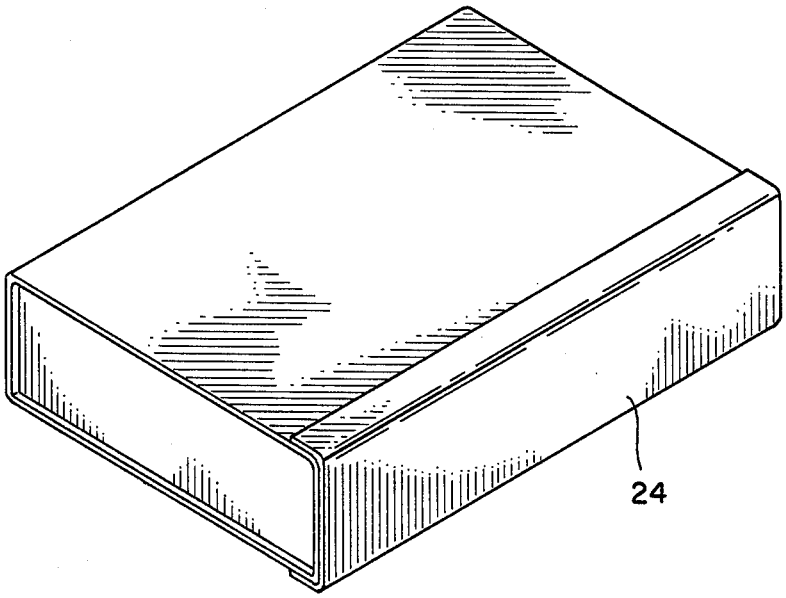
FIG. 5 is a perspective view of a second embodiment of the present invention showing the friction strip in a covered condition.
Figure 6:
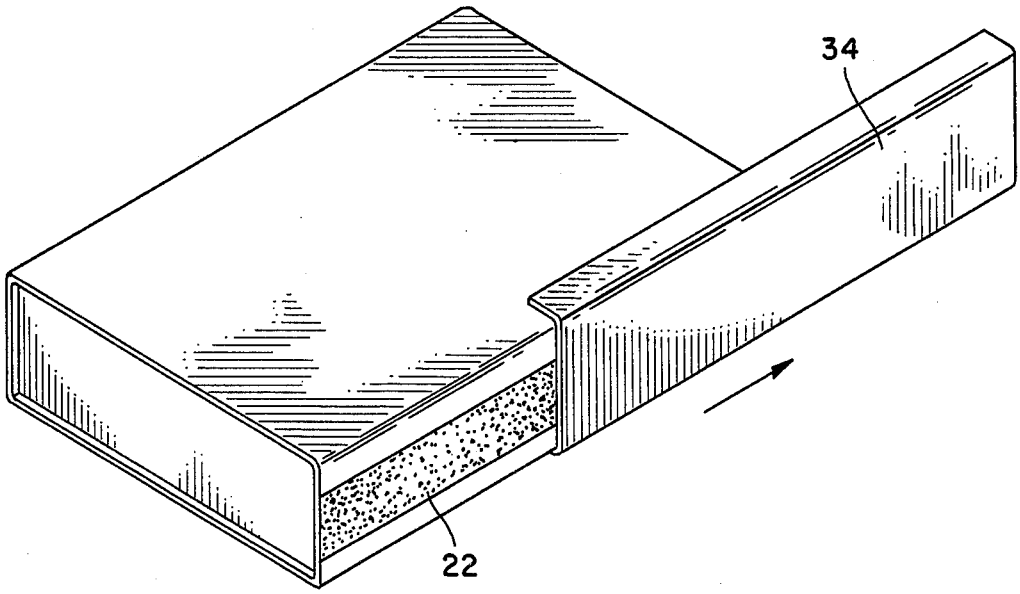
FIG. 6 is a perspective view of the embodiment of FIG. 5, however showing the friction strip in an exposed condition.

With reference to FIGS. 5 and 6, a second embodiment of the present invention is seen. In this embodiment, the friction strip 22 is affixed to the narrow longitudinal length of the outer surface of a box of stick matches.

As is noted in FIG. 5, a protective length of cardboard 24 normally covers the protective strip 22. Only when ignition of a stick match is desired, is the protective cover 24 slid in the direction indicated by the arrow in FIG. 6, in order to expose the strip 22, thereby rendering the box amenable to striking by a match removed therefrom.

Figure 7:
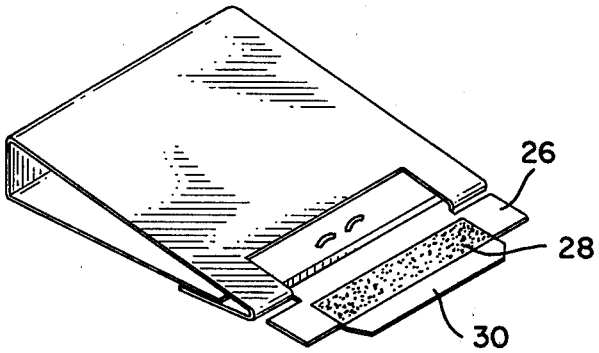
FIG. 7 is a perspective view of a third embodiment of the present invention.
Figure 8:
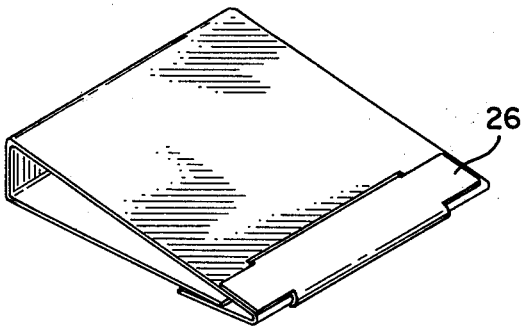
FIG. 8 is a perspective view of the embodiment of FIG. 7 in the closed position.

Shown in FIGS. 7 and 8 is a third embodiment of the present invention in which a safety cover is provided for what, generally, is a booklet similar to a conventional safety match booklet.

It is to be noted that said third embodiment includes a flip-out panel 26 which includes a friction strip 28 and a lip 30 which enables the panel 26 to remain closed when usage of the friction strip is not required. This fold-in feature of the lip 30 is more particularly shown in FIG. 8.

It is to be appreciated that the striking of a match can be achieved only after the panel 26 has been released from the position of FIG. 8.

While there have been herein shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

Having thus described my invention what I claim as new, useful and non-obvious and accordingly secure by Letters Patent of the United States is:

1. A matchbook safety system, comprising:

a. a matchbook cover having a narrow transverse opening at or near the area of attachment of the matches to the cover; and b. a separate safety panel being slidably inserted behind the matches and, further, having a tongue portion upon both sides of which are disposed friction strips, said tongue adapted for press-fittable insertion into and retraction from said narrow transverse opening, whereby ignition of a match cannot be effectuated except by manual extension of the safety panel.

* * * * *